US008622517B2

(12) United States Patent
Ishikawa et al.

(10) Patent No.: US 8,622,517 B2
(45) Date of Patent: Jan. 7, 2014

(54) METHOD OF MANUFACTURING LIQUID EJECTION HEAD AND LIQUID EJECTION HEAD

(71) Applicant: Canon Kabushiki Kaisha, Tokyo (JP)

(72) Inventors: Masashi Ishikawa, Kawasaki (JP); Takayuki Ono, Kawasaki (JP); Masao Furukawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/653,779

(22) Filed: Oct. 17, 2012

(65) Prior Publication Data

US 2013/0100208 A1 Apr. 25, 2013

(30) Foreign Application Priority Data

Oct. 21, 2011 (JP) ..... 2011-231749

(51) Int. Cl.
*B41J 2/15* (2006.01)
*B41J 2/145* (2006.01)

(52) U.S. Cl.
USPC ..... 347/40; 347/65

(58) Field of Classification Search
USPC ..... 347/9–12, 20, 40, 42, 44–45, 47, 49, 347/56, 61, 65, 67, 84–85
See application file for complete search history.

(56) References Cited

U.S. PATENT DOCUMENTS

2012/0212540 A1* 8/2012 Dietl ..... 347/29

FOREIGN PATENT DOCUMENTS

JP 2007-55071 A 3/2007

* cited by examiner

*Primary Examiner* — Thinh Nguyen
(74) *Attorney, Agent, or Firm* — Canon USA, Inc., IP Division

(57) ABSTRACT

A method of manufacturing a liquid ejection head includes: defining a first imaginary reference line along the longitudinal direction of a base member and measuring the distances between the first imaginary reference line and at least two liquid supply port portions of a liquid supply port row, including defining a second imaginary reference line passing the liquid supply port portion at the shortest distance from the first imaginary reference line and the liquid supply port portion at the longest distance from the first imaginary reference line respectively from among the at least two liquid supply port portions and defining the second imaginary reference line between two imaginary lines parallel to the first imaginary reference line.

14 Claims, 10 Drawing Sheets

METHOD OF MANUFACTURING LIQUID EJECTION HEAD AND LIQUID EJECTION HEAD

BACKGROUND OF THE INVENTION

1. Field of the Invention

The present invention relates to a method of manufacturing a liquid ejection head and a liquid ejection head.

2. Description of the Related Art

A liquid ejection recording apparatus configured to eject a liquid such as ink (hereinafter, referred to simply as a recording apparatus) is widely used and implemented in output apparatuses and the like relating to computers. In recent years, there has been a demand for a liquid ejection head (hereinafter, also referred to simply as a recording head or a head) having a longer printing width in order to output high quality images at higher speed.

Examples of widely known general recording apparatuses include a system of performing printing by scanning a recorded medium such as paper with the recording head while ejecting ink. Also known is a so-called full-line-type recording apparatus which is capable of performing high-speed printing by fixing a head having a long printing width corresponding to the length of the recorded medium above a conveyor belt that conveys the recorded medium and scanning the recorded medium therewith.

The proposed configuration of the full-line-type recording head described above is a configuration in which a plurality of liquid ejection devices having a suitable length (having a suitable number of nozzles) are arranged on a base member to realize a recording head having a long printing width as a whole described in Japanese Patent Laid-Open No. 2007-55071.

In the recording head in this configuration, a method of forming reference points on the base member to allow the liquid ejection devices to be bonded at predetermined positions on the base member and applying an adhesive agent or bonding the liquid ejection devices with respect to the reference points is employed.

However, if the length of the base member is increased to obtain a longer printing width, the base member may warp in the short side direction. In other words, the reference points formed on the base member are shifted in the short side direction, and if the adhesive agent is applied on the basis of the shifted reference points, there arises a problem that the adhesive agent may enter liquid supply port portions for supplying ink to the liquid ejection devices. As a countermeasure for such a situation, a method of detecting an amount of warping of the base member and changing positions where the adhesive agent is applied individually from one liquid supply port portion to another according to the amount of warping has been contemplated. However, with this method, the productivity of the heads is reduced.

SUMMARY OF THE INVENTION

A method of manufacturing a liquid ejection head including a base member having a liquid supply port row including a plurality of liquid supply port portions for supplying liquid formed in the longitudinal direction, and a plurality of liquid ejection devices arranged at positions corresponding to the liquid supply port portions and bonded to the base member with an adhesive agent, the method including: defining a first imaginary reference line along the longitudinal direction of the base member and measuring the distances between the first imaginary reference line and at least two liquid supply port portions of the liquid supply port row; defining a second imaginary reference line passing through the liquid supply port portion at the shortest distance from the first imaginary reference line and the liquid supply port portion at the longest distance from the first imaginary line respectively from among the at least two liquid supply port portions and defining the second imaginary reference line between two imaginary lines parallel to the first imaginary reference line; applying the adhesive agent on the base member on the basis of the second imaginary reference lines; and bonding the liquid ejection devices on the base member with the adhesive agent applied on the base member.

A method of manufacturing a liquid ejection head including a base member having a liquid supply port row including a plurality of liquid supply port portions for supplying liquid formed in the longitudinal direction, and a plurality of liquid ejection devices arranged at positions corresponding to the liquid supply port portions and bonded to the base member with an adhesive agent, the method including: defining a second imaginary reference line between a first imaginary reference line extending along the longitudinal direction of the base member and a reference point at the largest distance from the imaginary reference line from among a plurality of reference points formed along the longitudinal direction so as to extend along the first imaginary reference line; applying the adhesive agent on the base member on the basis of the second imaginary reference lines; and bonding the liquid ejection devices on the base member with the adhesive agent applied on the base member.

A liquid ejection head includes a base member having a liquid supply port row including a plurality of liquid supply port portions arranged in the longitudinal direction and liquid ejection devices arranged at positions corresponding to the liquid supply port portions and bonded to the base member with an adhesive agent formed around the liquid supply port portions, wherein the distance between a first opening end of a first liquid supply port portion formed at one end side in the direction of arrangement from among the plurality of liquid supply port portions in the direction of a first short side orthogonal to the longitudinal direction and an outer peripheral end of the adhesive agent formed outside the first opening end on the outer peripheral side is larger than the distance between a second opening end in a second short side direction opposite from the first short side direction and an end portion of the adhesive agent formed outside the second opening end, and the distance between a third opening end of a second liquid supply port portion formed at a center in the direction of arrangement from among the plurality of liquid supply port portions in the direction of the first short side and an end of the adhesive agent formed outside the third opening end on the outer peripheral side is smaller than the distance between a fourth opening end in the second short side direction and an outer peripheral end portion of the adhesive agent formed outside the fourth opening end.

Further features of the present invention will become apparent from the following description of exemplary embodiments with reference to the attached drawings.

DESCRIPTION OF THE EMBODIMENTS

Figure 1:
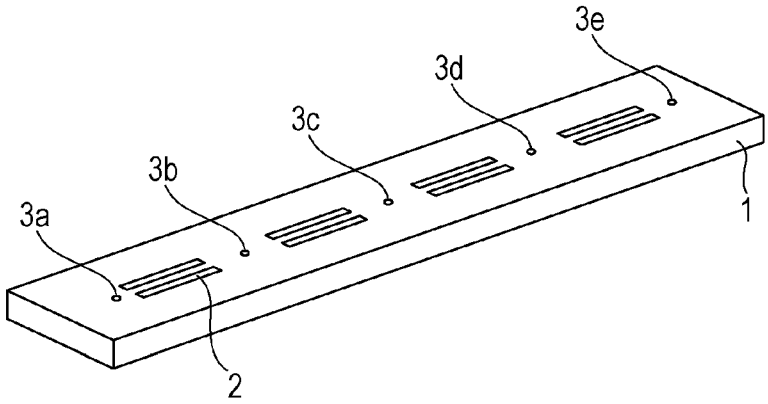
FIG. 1 is a schematic perspective view of a base member used in a method of manufacturing according to a first embodiment.

Referring now to the drawings, embodiments will be described.

First Embodiment

A liquid ejection head manufactured by a method of manufacturing according to a first embodiment includes a base member formed with a liquid supply port row having a plurality of liquid supply port portions arranged in a row in the longitudinal direction, and liquid ejection devices arranged at positions corresponding to the liquid supply port portions.

FIG. 1 is a schematic perspective view of the base member as a supporting member that supports liquid ejection devices 4 used in the manufacturing method of the first embodiment described later. The material used for a base member 1 is alumina material having insulating properties, thermal conductivity, and mechanical strength. The base member 1 is provided with liquid supply port portions 2 formed in a line in the longitudinal direction and configured to supply ink to the liquid ejection device (not shown in FIG. 1). In the first embodiment, the liquid supply port portions 2 are composed of two openings, which are through holes, but are not limited thereto, and may be composed of an arbitrary number of openings. Furthermore, the base member 1 is formed with reference points 3*a* to 3*e* for measuring positions of the liquid supply port portions 2 as described later.

Figure 2:
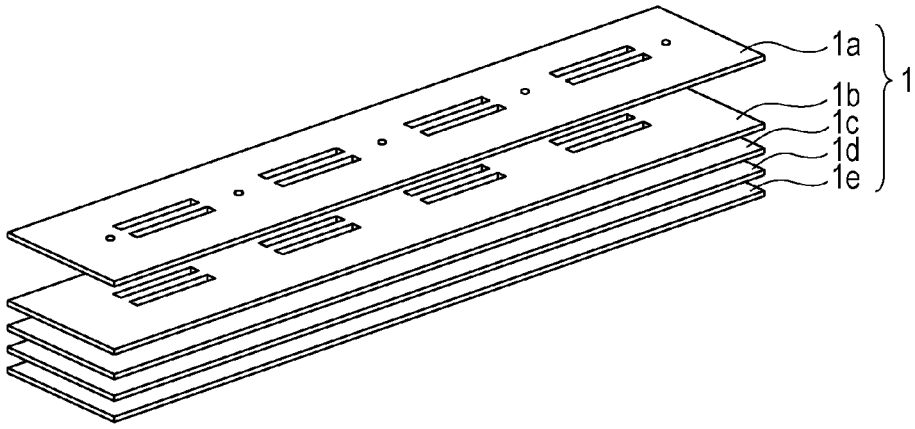
FIG. 2 is an exploded perspective view of the base member illustrated in FIG. 1.

A method of manufacturing the base member 1 will be described with reference to FIG. 2. In this embodiment, the base member 1 is unified by laminating a plurality of layers 1*a* to 1*e* as illustrated in FIG. 2. The reference points 3 (3*a* to 3*e*) are formed on the first layer 1*a* by laser beam machining together with the openings of the liquid supply port portions 2. In this case, a laser beam machining apparatus (not shown) is controlled to form the openings of the liquid supply port portions 2 and the reference points 3 by performing machining through a series of processes after the first layer 1*a* prior to being subjected to laser beam machining is fixed in position. Therefore, the accuracy of the relative positions of the openings of the liquid supply port portions 2 and the reference points 3 is very high, and the reference points 3*a* to 3*e* are formed in a line. Only the openings of the liquid supply port portions 2 are formed on the second layer 1*b*, and a flow channel (not shown) for supplying ink to the liquid supply port portions 2 is formed on the third layer 1*c*. Subsequently, when the layers 1*a* to 1*e* are stacked and sintered at approximately 1200° C., the respective layers 1*a* to 1*e* are sintered and the unified base member 1 is formed. The formation of the openings of the liquid supply port portions 2 or the reference points 3 on the respective layers 1*a* to 1*e* may be performed by punching using a die.

The base member 1 unified by being sintered in this manner is subjected to slight contraction at the time of sintering, and simultaneously is subjected to warping. The warping occurs both in the thickness direction of the base member 1 (mainly in the longitudinal direction of the base member) and in the in-plane direction (mainly in the short side direction of the base member). The warping in the thickness direction of the base member 1 (mainly in the longitudinal direction) may be reduced by grinding the base member 1, but there is no way to reduce the warping in the in-plane direction (mainly in the short side direction), and the warping that was generated at the time of sintering remains.

Subsequently, a process flow of the method of manufacturing of the first embodiment will be described.

Figure 3:
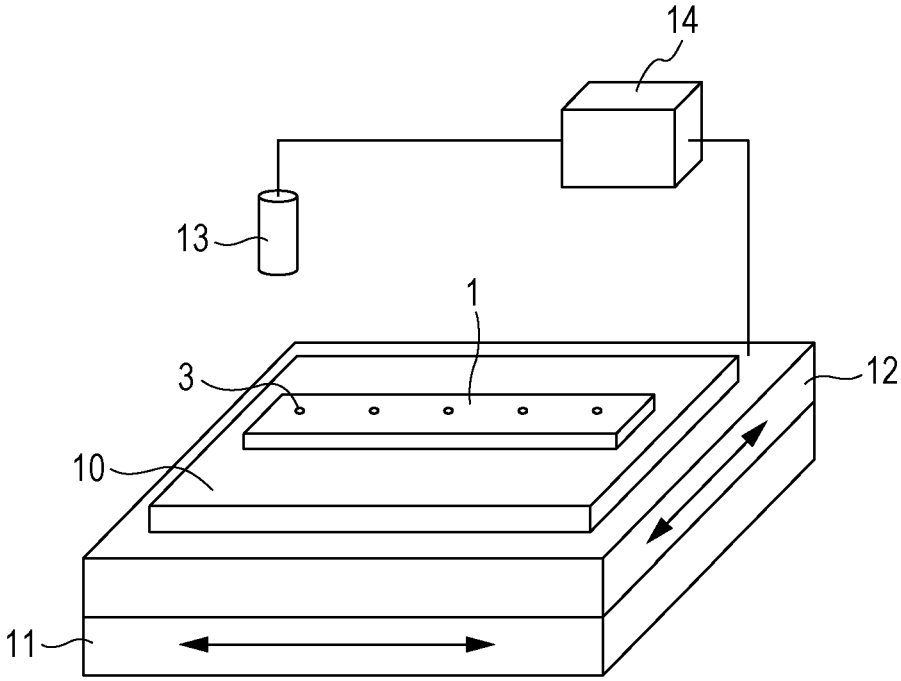
FIG. 3 is a schematic perspective view illustrating a measuring device configured to measure positions of reference points on the base member.
Figure 4:
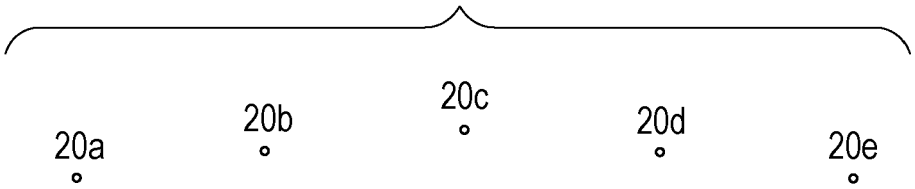
FIG. 4 is a plot showing a positional relationship of reference points formed on the base member in FIG. 1.

First of all, a process of measuring the positions of the reference points 3 will be performed using a measuring device illustrated in FIG. 3. In this process, the base member 1 is arranged on a plate 10 with the surface from which the liquid supply port portions 2 (not illustrated in FIG. 3) are opened facing upward. The plate 10 is placed on a stage 11 driving the base member 1 in the longitudinal direction of the base member 1 and a stage 12 configured to drive in the short side direction of the base member 1. A camera 13 for photographing the reference points 3 is installed above the base member 1, and the camera 13 and the stages 11 and 12 are connected to a control device 14. The positions of the reference points 3 are measured by the control device 14 from the positions of the stages 11 and 12 and an image photographed by the camera 13. FIG. 4 illustrates the positional relationship of the reference points measured in this manner, and plots 20*a* to 20*e* corresponding to the respective reference points 3*a* to 3*e* are illustrated. The plots 20*a* to 20*e* as described above are arranged along a curved line in keeping with the warping in the short side direction of the base member 1 generated when manufacturing the base member 1.

Figure 5A:
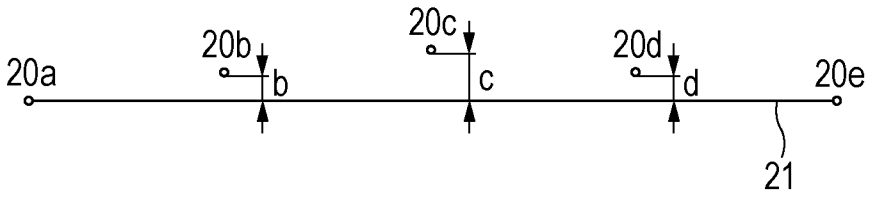
FIGS. 5A and 5B are explanatory drawings for explaining processes of defining reference lines for applying an adhesive agent according to the first embodiment.
Figure 5B:
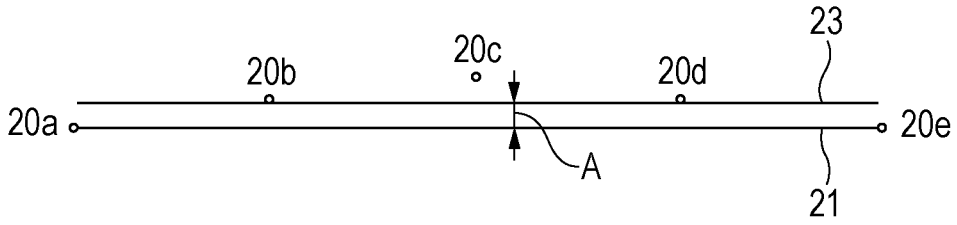

Subsequently, a process of defining the reference lines for applying the adhesive agent on the basis of the positions of the measured reference points is performed. FIGS. 5A and 5B are explanatory drawings for explaining the process, and are drawings corresponding to FIG. 4.

As illustrated in FIG. 5A, an imaginary line connecting the plots 20*a* and 20*e* at both ends is designated as an inclined reference line (first imaginary reference line) 21. Subsequently, distances (interval) a to e from the inclined reference line 21 to the respective plots 20*a* to 20*e* (a=e=0 in this embodiment) are calculated. In this embodiment, the plot 20*c* is farthest from the inclined reference line 21 and the distance therefrom is "c". Then, as illustrated in FIG. 5B, an imaginary line which is an imaginary line parallel to the inclined reference line 21 and which falls within a range of 0<A<c, where A is a shift amount from the inclined reference line 21 is defined as a reference line (second imaginary reference line) 23 for applying the adhesive agent. The reference line 23 for applying the adhesive agent is most preferably defined so that the shift amount A from the inclined reference line 21 becomes half the distance c from the farthest plot 20*c* (A=c/2). Accordingly, the maximum distance from among the distances between the reference line for applying the adhesive agent and the respective plots is minimized.

Figure 6A:
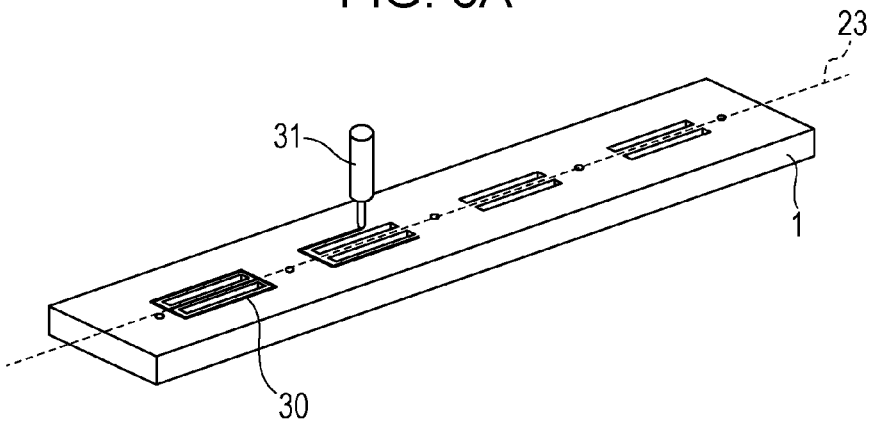
FIG. 6A is a perspective view illustrating a state in which the adhesive agent is applied to the base member in FIG. 1.
Figure 6B:
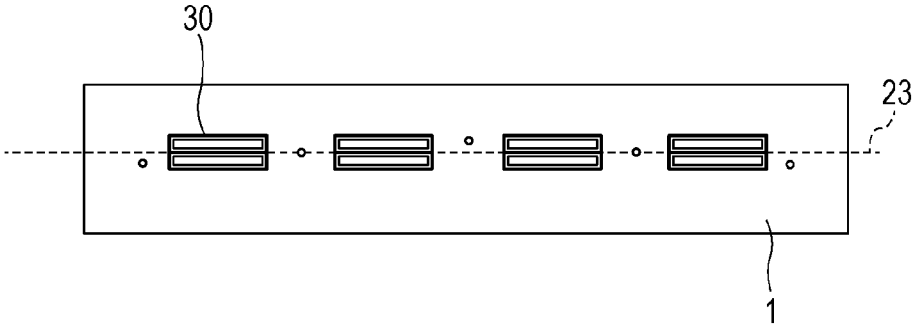
FIG. 6B is a plan view of the base member in FIG. 6A.

Subsequently, a process of applying an adhesive agent 30 is performed. In this process, the adhesive agent 30 is applied to the base member 1 using an application needle 31 as illustrated in FIG. 6A so as to surround peripheries of the liquid supply port portions 2 to conform with to the second imaginary reference line 23 as illustrated in FIG. 6B. Accordingly, a value of the maximum shifted amount from among the positional shifted amounts of the respective liquid supply port portions with respect to the second imaginary reference line 23, that is, the position at which the adhesive agent is to be applied is minimized. In the first embodiment, a method of using the application needle 31 is described as the method of applying the adhesive agent 30, other methods such as a transfer system may be employed.

Figure 7:
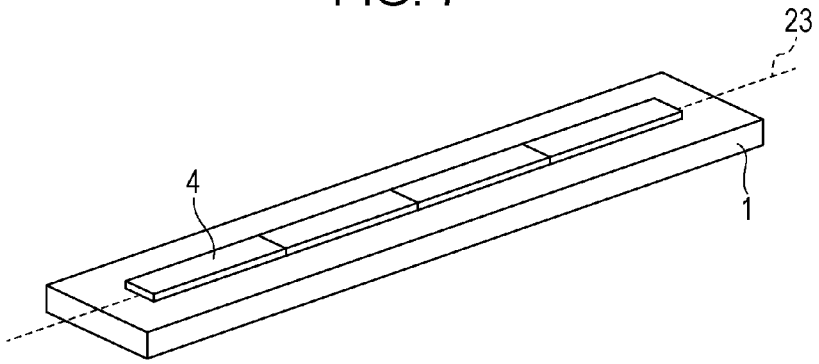
FIG. 7 is a schematic perspective view of a liquid ejection head according to the first embodiment.

Subsequently, a process of bonding the liquid ejection devices 4 to the base member 1 having the adhesive agent applied thereto is performed as described above. In this process, as illustrated in FIG. 7, the liquid ejection devices 4 as recording element substrates that eject liquid are bonded to the base member 1 to conform with the positions where the adhesive agent is applied, that is, to conform with the second imaginary reference line 23.

In the liquid ejection head obtained in this manner, in addition to the capability of applying the adhesive agent to effective positions which inhibit entry of the adhesive agent into the liquid supply port portions, a large bonding surface area between the adhesive agent and the liquid ejection devices is secured. Therefore, a high bonding strength of the liquid ejection devices is obtained. In this case, the positions of the liquid ejection devices are different from one liquid ejection head to another, and hence it is to be noted that ink ejection timing needs to be controlled individually when mounting the heads on a main body.

The liquid ejection head obtained by the method of manufacturing described above has a form in which the relationship between an opening end and the adhesive agent satisfies the following relationship in the outermost (on end portion side in the direction of arrangement) first liquid supply port portion from among the plurality of liquid supply port portions. In other words, the distance between a first opening end and an outer end of the adhesive agent applied outside the first opening end which is determined in the direction orthogonal to the longitudinal direction of the base member is different from the distance between a second opening end opposite the first opening end and an outer end of the adhesive agent applied outside the second opening end. The magnitude relation of the distances is different from that in the case of the second liquid supply port portion in the vicinity of a center portion of the base member, and the difference between absolute values of the distances is equal to that in the case of the second liquid supply port portion.

In the first embodiment, the positions of the reference points 3 are measured instead of measuring the positions of the respective liquid supply port portions 2 of the liquid supply port row. However, the positions of the liquid supply port portions 2 may be measured directly. However, if the base member 1 is formed of a stacked member, and hence the liquid supply port portions are formed across the plurality of layers, there is a probability of erroneous detection of the positions of the liquid supply port portions due to the influence of inter-layer shifting occurring at the time of the image processing of the liquid supply port portions. Therefore, as in the first embodiment, the measurement of the positions of the reference points 3 is preferable. In this case, in order to avoid the erroneous detection of the positions of the reference points due to the inter-layer shifting, the reference point is preferably formed only on the first layer of the base member. In the first embodiment, five of the reference points are provided. However, only at least three of the reference points at both ends of the base member in the longitudinal direction and in the vicinity of the center portion have to be provided. The reference points at the both ends of the base member are preferably provided outside the liquid supply port portion located at the outermost position from among the plurality of liquid supply port portions. The arrangement of the reference points may be selected from any suitable shape as long as positions can be measured accurately.

Second Embodiment

A second embodiment is different from the first embodiment in that the liquid ejection devices bonded to the base member to conform with the reference line (second imaginary reference line) for applying the adhesive agent in the first embodiment are bonded to the reference points of the base member. In conjunction with this, the most desirable position of the second imaginary reference line is also changed. Other configurations are the same as the first embodiment. In the following description, only processes different from those in the first embodiment will be described, and description of other processes will be omitted.

Referring to FIGS. 6A and 6B, a process of defining the second imaginary line of the second embodiment will be described. In terms of preventing entry of the adhesive agent into the liquid supply port portion, the second imaginary reference line 23 is an imaginary line parallel to the inclined reference line (first imaginary reference line) 21 and is defined as an imaginary line in a range 0<A<c where the shift amount from the inclined reference line 21 is A. This is the same as the first embodiment. However, if the shift amount A is increased, the shifting amount between the position of the imaginary line connecting the reference points at the both ends of the base member, that is, the liquid ejection devices to be bonded onto the inclined reference line 21 and the adhesive agent to be applied in conformity with the second imaginary reference line 23 is increased. If the liquid ejection devices and the adhesive agent are shifted, the adhesive agent adhered to back surfaces of the liquid ejection devices are biased and the positions of the liquid ejection devices may be deviated due to hardening or contraction of the adhesive agent. As the countermeasure for entry of the adhesive agent into the liquid supply port portions the same effects are obtained in the case where the shift amount A of the second imaginary reference line 23 is 0<A<c/2 and the case where the shift amount A of the same is c/2<A<c. Therefore, in terms of reduction of the shift amount A, the second imaginary reference line 23 is preferably defined as the imaginary line whose shift amount falls within the range of 0<A<c/2.

Figure 8:
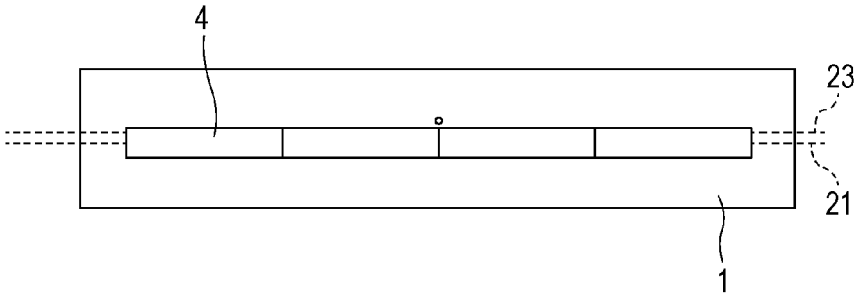
FIG. 8 is a schematic plan view of a liquid ejection head according to a second embodiment.

Subsequently, in the process of bonding the liquid ejection devices of the second embodiment to the base member, the liquid ejection devices 4 are bonded to the base member 1 on the inclined reference line 21 connecting the reference points at the both ends as illustrated in FIG. 8, and hence are bonded at positions deviated from the second imaginary reference line 23.

In the liquid ejection head obtained in this manner, in addition to the reduction of probability of entry of the adhesive agent to the liquid supply port portions, definition of the positions of the liquid ejection devices by the positions from the imaginary line connecting the reference points at the both ends of the base member 1 with respect to all the base members. Therefore, according to the method of manufacturing of the second embodiment, mounting of other head components and ejection control at the time of mounting of the heads on the main body is facilitated.

Third Embodiment

A third embodiment is a mode of performing the method of bonding the liquid ejection devices of the first embodiment in a specific method. In other words, in this embodiment, after the bonding of the first liquid ejection device so as to conform to the position where the adhesive agent is applied, positioning of the second liquid ejection device is performed using the bonded liquid ejection device. In this manner, the liquid ejection device bonded previously is used for the positioning of the liquid ejection device to be bonded next to bond the liquid ejection devices in sequence. In this embodiment, the first liquid ejection device is bonded in conform to the positions where the adhesive agent is applied. However, the liquid ejection device may be bonded to conform with the reference point of the base member as in the second embodiment.

In the liquid ejection head obtained in this manner, the entry of the adhesive agent into the liquid supply port portions may be reduced. In addition, since the adjacent liquid ejection device may be positioned with high degree of accuracy, deterioration of a printed image at the joint portions between the liquid ejection devices is effectively reduced.

Fourth Embodiment

A liquid ejection head manufactured by a method of manufacturing according to a fourth embodiment includes a base member formed with a liquid supply port row having a plurality of liquid supply port portions arranged in a plurality of rows in the short side direction, and liquid ejection devices arranged at positions corresponding to the liquid supply port portions.

Figure 9:
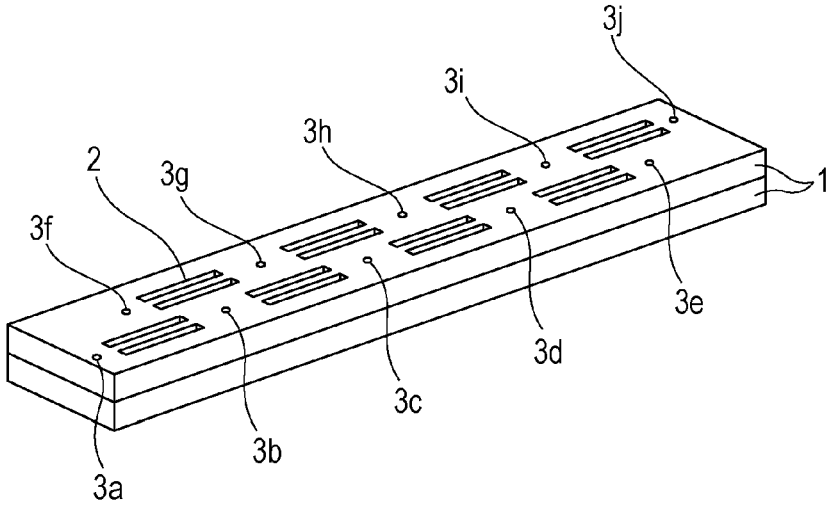
FIG. 9 is a schematic perspective view of a base member used in a method of manufacturing according to a fourth embodiment.

FIG. 9 is a schematic perspective view of the base member used in the method of manufacturing according to the fourth embodiment. The base member 1 is provided with the liquid supply port portions 2 which constitute two rows of ink ejection port rows formed in a zigzag shape and extending in the longitudinal direction. The base member 1 is formed with reference points 3*a* to 3*j*. In the fourth embodiment, there are provided five of the reference points for each of the liquid supply port rows including outside of the liquid supply port portions positioned at both ends of the liquid supply port row and intermediate points of the respective liquid supply port portions. However, the invention is not limited thereto and only at least three of the reference points including the both ends and a point in the vicinity of the center point the liquid supply port row of each of the liquid supply port row have to be provided.

Subsequently, a process flow of the method of manufacturing of the fourth embodiment will be described.

Figure 10:
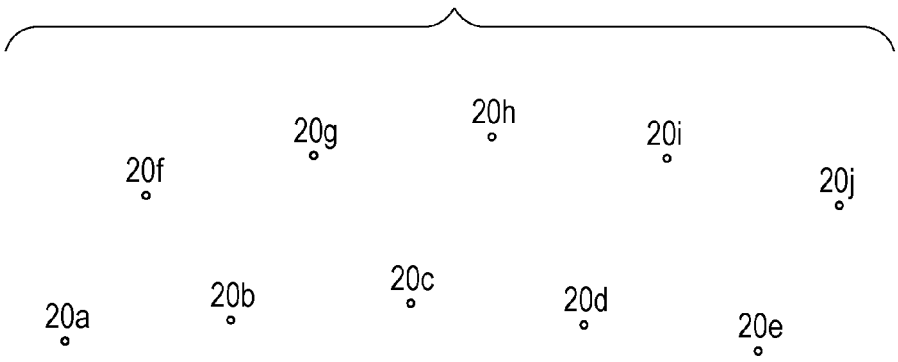
FIG. 10 is a plot showing a positional relationship of reference points formed on the base member in FIG. 9.

First of all, in the same manner as the first embodiment, the process of measuring the positions of the reference points will be performed using the measuring device illustrated in FIG. 3. FIG. 10 illustrates the positional relationship of the measured reference points, and plots 20*a* to 20*j* corresponding to the respective reference points 3*a* to 3*j* are illustrated.

Figure 11A:
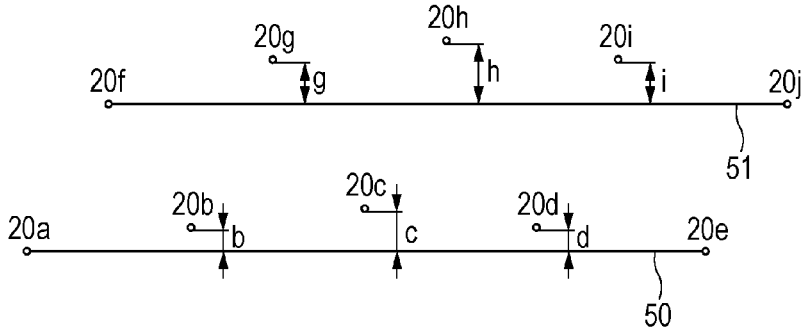
FIGS. 11A and 11B are explanatory drawings for explaining processes of defining reference lines for applying an adhesive agent according to the fourth embodiment.
Figure 11B:
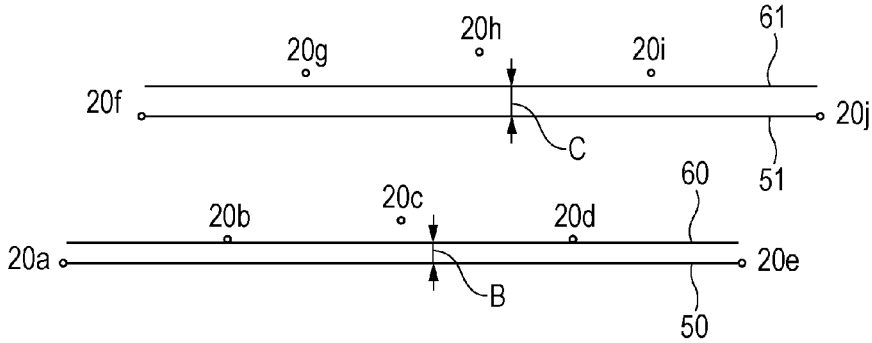

Subsequently, a process of defining the reference lines (second imaginary reference lines) for applying the adhesive agent on the basis of the positions of the measured reference points. FIGS. 11A and 11B are explanatory drawings for explaining the process, and are drawings corresponding to FIG. 10.

As illustrated in FIG. 11A, the line connecting the plots 20*a* and 20*e* at the both ends of the liquid supply port row for the lower level is defined as an inclination reference line 50 for lower level, and a line connecting the plots 20*f* and 20*j* at the both ends of the liquid supply port row on the upper level is defined as an inclination reference line 51 for the upper level. Subsequently, the distances a to j from the inclined reference lines 51 and 52 to the respective plots (a=e=f=j=0 in this embodiment) are calculated. In the liquid supply port row for the lower level, the plot 20*c* is farthest from the inclination reference line 50 for lower level, and the distance is c. In the liquid supply port row on the upper level, the plot 20*h* is farthest from the inclination reference line 51 for upper level, and the distance is h. In the embodiment, the relation of magnitudes of the distances is h>c, and the states of warping are different between the liquid supply port rows on the upper level and the lower level. A reference line 60 for applying the adhesive agent for the lower level is an imaginary line parallel to the inclined reference line 50 for the lower level, and is defined as an imaginary line in a range 0<B<c where the shift amount from the inclined reference line 50 for the lower level is B. The second imaginary reference line 60 for the lower level is most preferably defined so that the shift amount B from the inclined reference line 50 for the lower level becomes half the distance c from the farthest plot 20*c* (B=c/2). Accordingly, in the liquid supply port row for the lower side, the largest distance among the distances between the second imaginary reference line 60 and all the plots 20*a* to 20*e* may be reduced. Therefore, the reference line 60 for applying the adhesive agent, that is, the largest positional shift amount between the position where the adhesive agent is applied and the liquid supply port row may be reduced to a small value. Therefore, the fourth embodiment is the most advantageous mode in terms of reducing the entry of the adhesive agent into the liquid supply port portions 2. As regards the upper level as well, a reference line 61 for applying the adhesive agent is defined so that the shift amount C from the inclination reference line 51 for upper level falls within a range 0<C<h, and a case where the shift amount C is half the distance h (C=h/2) is most effective for the entry of the adhesive agent into the liquid supply port portions 2.

Figure 12:
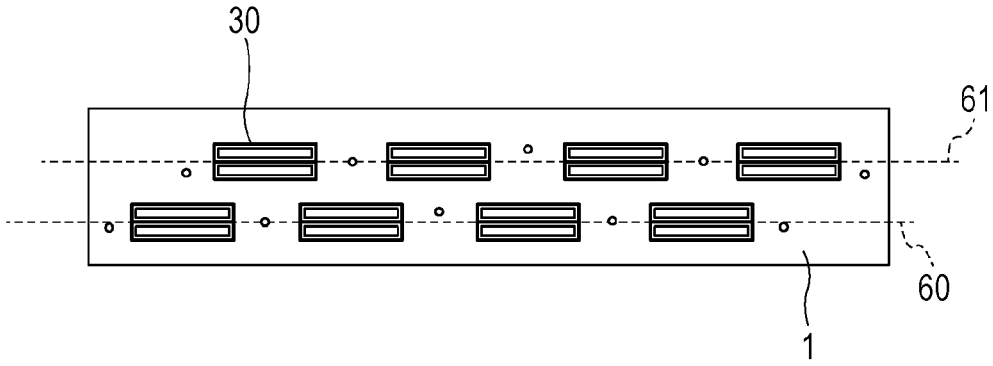
FIG. 12 is a plan view illustrating a state in which the adhesive agent is applied to the base member in FIG. 9.

Subsequently, a process of applying the adhesive agent 30 is performed. In this process, the adhesive agent 30 is applied to the base member 1 as illustrated in FIG. 12 so as to surround the peripheries of the liquid supply port portions 2 to conform with the upper and lower reference lines 60 and 61 for applying the adhesive agent.

Figure 13A:
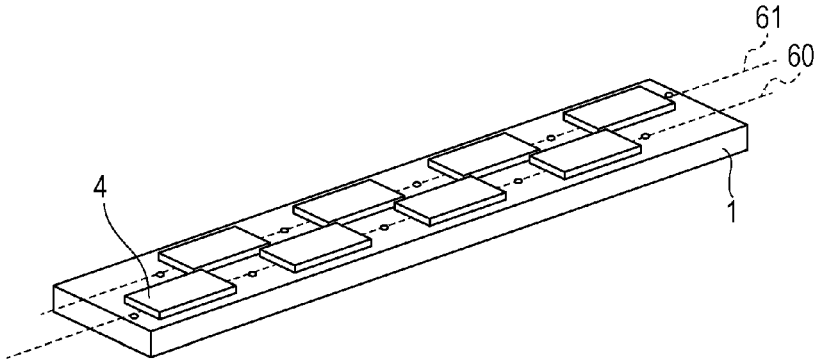
FIG. 13A is a schematic perspective view of a liquid ejection head according to the fourth embodiment.
Figure 13B:
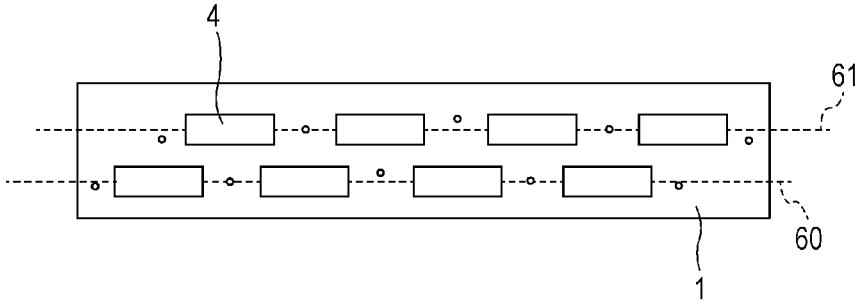
FIG. 13B is a schematic plan view of the liquid ejection head shown in FIG. 13A.

Subsequently, a process of bonding the liquid ejection device 4 to the base member 1 having the adhesive agent applied thereto is performed as described above. In this process, as illustrated in FIGS. 13A and 13B, the liquid ejection devices 4 are bonded to conform with the adhesive agent applied to the upper and lower second imaginary reference lines 60 and 61.

In the liquid ejection head obtained in this manner, since the adhesive agent is applied to the most effective positions in all the liquid supply port rows, the entry of the adhesive agent into the liquid supply port portions may be reduced. In addition, a larger bonding surface area is obtained between the adhesive agent and the liquid ejection devices, and hence the higher bonding strength of the liquid ejection devices may be obtained. In this embodiment as well, since the positions of the liquid ejection devices are different from head to head, the ink ejection timing is needed to be controlled individually to accommodate such difference at the time of mounting the head on the main body in the same manner as the first embodiment.

Fifth Embodiment

A fifth embodiment is a modification of the fourth embodiment in which the position of the second imaginary reference line is changed. More specifically, the reference line (second imaginary reference line) for applying the adhesive agent is defined for one of the liquid supply port rows in the same manner as the fourth embodiment, and the position of the reference line for the other liquid supply port row is determined on the basis of the prescribed second imaginary reference line. Other configurations are the same as the fourth embodiment. In the following description, only processes different from those in the fourth embodiment will be described, and description of other processes will be omitted.

Figure 14:
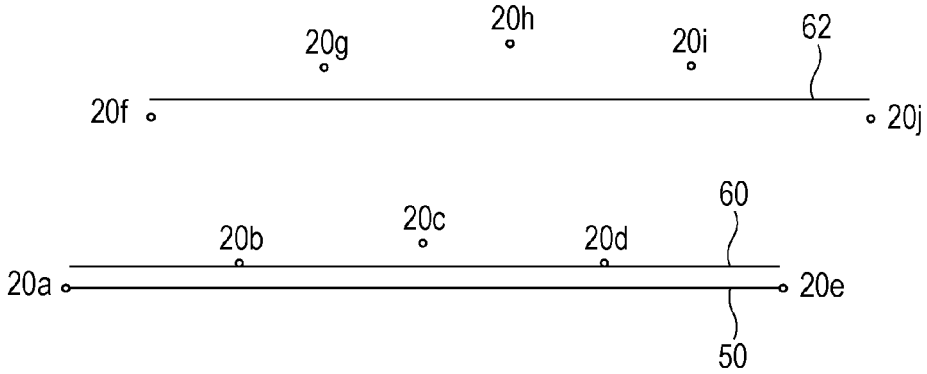
FIG. 14 is an explanatory drawing for explaining steps of defining reference lines for applying an adhesive agent according to a fifth embodiment.

Referring now to FIG. 14, a process of defining the reference lines for applying the adhesive agent according to the fifth embodiment will be described. FIG. 14 is an explanatory drawing for explaining the process, and the plots 20*a* to 20*j* corresponding to the respective reference points on the base member are illustrated. In FIG. 14, for the sake of convenience of explanation, the plots are illustrated with respect to both of the upper and lower liquid supply port rows (the positions of the reference points are measured). However, the positions of the reference points have to be measured only for the liquid supply port rows for which the second imaginary reference line is defined from among the plurality of liquid supply port rows.

In this embodiment, the second imaginary reference line 60 is defined in the method illustrated in the third embodiment with respect to the plots 20*a* and 20*e* for the liquid supply port row for the lower level. The shift amount B from the inclined reference line 50 for the lower level of the second imaginary reference line 60 for the lower level is most preferably defined to be half the distance c from the farthest plot 20*c*. Then, an imaginary line obtained by translating the second imaginary reference line 60 for the lower level in parallel by a pitch of the liquid supply port row is defined as a second imaginary reference line 62 for the upper level.

Figure 15:
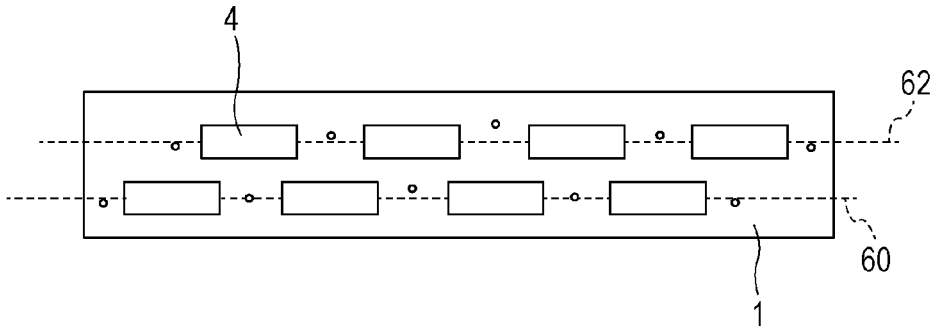
FIG. 15 is a schematic plan view of a liquid ejection head according to the fifth embodiment.

After the definition of the second imaginary reference line, the process of applying the adhesive agent and the process of bonding the liquid ejection device are performed in the same manner as in the fourth embodiment, whereby the liquid ejection head illustrated in FIG. 15 will be completed.

With the liquid ejection head in this configuration, application of the adhesive agent to the positions most effective for the reduction of entry of the adhesive agent into the liquid supply port portions is enabled for the liquid supply port row on the lower level. As regards the liquid supply port row on the upper level, entry of the adhesive agent into the liquid supply port portions may be reduced. Since the pitches between rows of the liquid ejection devices may be equalized, ejection control at the time of mounting the head on the main body is facilitated.

Sixth Embodiment

In a sixth embodiment, the liquid ejection devices are bonded in conformity with the inclination reference line in the same manner as in the second embodiment after determination of the positions of the respective second imaginary reference lines in the manner described in the fifth embodiment.

The liquid ejection head obtained in the sixth embodiment is subjected to deviation between the positions where the adhesive agent is applied and the positions of the liquid ejection devices as in the second embodiment. Therefore, the preferable mode in the fifth embodiment is as follows. In other words, the second imaginary reference lines are defined by using the liquid supply port row having the smallest positional displacements of the respective reference points with respect to the imaginary line (inclination reference line) connecting the reference points at the both ends of the liquid supply port row from among the plurality of liquid supply port rows. Then, as regards other liquid supply port rows, the lines obtained by translating the second imaginary reference line in parallel defined as described above by a pitch of the liquid supply port row is defined as the second imaginary reference lines of other liquid supply port rows.

In the liquid ejection head obtained in this manner, the distances between the imaginary lines connecting the reference points at the both ends of the respective liquid supply port rows and the adhesive agent in all the liquid supply port rows may be set to half the distance or smaller from the imaginary line to the reference point farthest from the imaginary line. Accordingly, the entry of the ink to the liquid supply port rows in all of the liquid supply port rows may be reduced, and the influence of the positional displacement between the adhesive agent and the liquid ejection devices on the movement of the liquid ejection devices may be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231749 filed Oct. 21, 2011, which is hereby incorporated by reference herein in its entirety.

What is claimed is:

1. A method of manufacturing a liquid ejection head including a base member having a liquid supply port row including a plurality of liquid supply port portions for supplying liquid formed in the longitudinal direction, and a plurality of liquid ejection devices arranged at positions corresponding to the liquid supply port portions and bonded to the base member with an adhesive agent, the method comprising:

defining a first imaginary reference line along the longitudinal direction of the base member and measuring the distances between the first imaginary reference line and at least two liquid supply port portions of the liquid supply port row;

defining a second imaginary reference line passing through the liquid supply port portion at the shortest distance from the first imaginary reference line and the liquid supply port portion at the longest distance from the first imaginary line respectively from among the at least two liquid supply port portions and defining the second imaginary reference line between two imaginary lines parallel to the first imaginary reference line;

applying the adhesive agent on the base member on the basis of the second imaginary reference lines; and bonding the liquid ejection devices on the base member with the adhesive agent applied on the base member.

2. The method of manufacturing a liquid ejection head according to claim 1, wherein the distance of at least the two liquid supply port portions is measured on the basis of a plurality of reference points provided on the base member.

3. The method of manufacturing a liquid ejection head according to claim 2, wherein the plurality of reference points include two of the reference points provided at both ends of the base member in the longitudinal direction.

4. The method of manufacturing a liquid ejection head according to claim 3, wherein the two reference points are formed respectively outside the two liquid supply port portions at outermost positions from among the plurality of liquid supply port portions.

5. The method of manufacturing a liquid ejection head according to claim 1, wherein the first imaginary reference line is defined so as to connect the two liquid supply port portions at the outermost positions from among the plurality of liquid supply port portions.

6. The method of manufacturing a liquid ejection head according to claim 1, wherein the second imaginary reference line is parallel to the first imaginary reference line.

7. The method of manufacturing a liquid ejection head according to claim 6, wherein the second imaginary reference line is at an equal distance from the two imaginary lines.

8. The method of manufacturing a liquid ejection head according to claim 1, wherein the liquid supply port portion includes a plurality of openings.

9. A method of manufacturing a liquid ejection head including a base member having a liquid supply port row including a plurality of liquid supply port portions for supplying liquid formed in the longitudinal direction, and a plurality of liquid ejection devices arranged at positions corresponding to the liquid supply port portions and bonded to the base member with an adhesive agent, the method comprising:

defining a second imaginary reference line between a first imaginary reference line extending along the longitudinal direction of the base member and a reference point at the largest distance from the imaginary reference line from among a plurality of reference points formed along the longitudinal direction so as to extend along the first imaginary reference line;

applying the adhesive agent on the base member on the basis of the second imaginary reference lines; and bonding the liquid ejection devices on the base member with the adhesive agent applied on the base member.

10. The method of manufacturing a liquid ejection head according to claim 9, wherein the first imaginary reference line is defined so as to connect the reference point on one end side and the reference point on the other end side from among the plurality of reference points.

11. The method of manufacturing a liquid ejection head according to claim 9, wherein the second imaginary reference line is defined between the reference point at the center from among the plurality of reference points disposed in the longitudinal direction of the base member and the first imaginary reference line.

12. The method of manufacturing a liquid ejection head according to claim 9, wherein the reference points are formed between the plurality of liquid supply portions.

13. A method of manufacturing a liquid ejection head including a base member having a liquid supply port row including a plurality of liquid supply port portions for supplying liquid formed in the longitudinal direction, and a plurality of liquid ejection devices arranged at positions corresponding to the liquid supply port portions and bonded to the base member with an adhesive agent, the method comprising:

defining a second imaginary reference line between a first imaginary reference line extending along the longitudinal direction of the base member and a liquid supply port portion at the largest distance from the imaginary reference line from among the plurality of liquid supply port portions formed along the longitudinal direction so as to extend along the first imaginary reference line;

applying the adhesive agent on the base member on the basis of the second imaginary reference lines; and bonding the liquid ejection devices on the base member with the adhesive agent applied on the base member.

14. A liquid ejection head comprising:

a base member having a liquid supply port row comprising a plurality of liquid supply port portions arranged in the longitudinal direction; and liquid ejection devices arranged at positions corresponding to the liquid supply port portions and bonded to the base member with an adhesive agent formed around the liquid supply port portions, wherein the distance between a first opening end of a first liquid supply port portion formed at one end side in the direction of arrangement from among the plurality of liquid supply port portions in the direction of a first short side orthogonal to the longitudinal direction and an outer peripheral end portion of the adhesive agent formed outside the first opening end on the outer peripheral side is larger than the distance between a second opening end in a second short side direction opposite from the first short side direction and an end portion of the adhesive agent formed outside the second opening end, and wherein the distance between a third opening end of a second liquid supply port portion formed at a center in the direction of arrangement from among the plurality of liquid supply port portions in the direction of the first short side and an end portion of the adhesive agent formed outside the third opening end on the outer peripheral side is smaller than the distance between a fourth opening end in the second short side direction and an outer peripheral end portion of the adhesive agent formed outside the fourth opening end.

* * * * *